US009972922B2

(12) United States Patent
Speith et al.

(10) Patent No.: US 9,972,922 B2
(45) Date of Patent: May 15, 2018

(54) CONNECTION TERMINAL HAVING A CLAMPING DEVICE ENGAGING AND CLAMPING A HOLDING DEVICE FOR CLAMPING AN ELECTRICAL CONDUCTOR

(71) Applicant: Weidmüller Interface GmbH & Co. KG, Detmold (DE)

(72) Inventors: Markus Speith, Paderborn (DE); Andreas Rutz, Bielefeld (DE); Thomas Köster, Schlangen (DE); Lukas Bastian, Schlagen (DE)

(73) Assignee: Weidmüller Interface GmbH & Co. KG (DE)

( * ) Notice: Subject to any disclaimer, the term of this patent is extended or adjusted under 35 U.S.C. 154(b) by 0 days. days.

(21) Appl. No.: 15/502,691

(22) PCT Filed: Aug. 11, 2015

(86) PCT No.: PCT/EP2015/068476
§ 371 (c)(1),
(2) Date: Feb. 8, 2017

(87) PCT Pub. No.: WO2016/023908
PCT Pub. Date: Feb. 18, 2016

(65) Prior Publication Data

US 2017/0229790 A1 Aug. 10, 2017

(30) Foreign Application Priority Data

Aug. 13, 2014 (DE) ..... 20 2014 103 754 U

(51) Int. Cl.
*H01R 4/40* (2006.01)
*H01R 12/59* (2011.01)
(Continued)

(52) U.S. Cl.
CPC ..... *H01R 4/40* (2013.01); *H01R 12/592* (2013.01); *H01R 13/502* (2013.01); *H01R 13/518* (2013.01); *H01R 9/24* (2013.01)

(58) Field of Classification Search
CPC ..... H01R 4/28; H01R 4/40; H01R 4/42
(Continued)

(56) References Cited

U.S. PATENT DOCUMENTS 3,177,459 A * 4/1965 Toedtman ..... H01R 11/15 24/335
3,459,397 A 8/1969 Hedberg
(Continued)

FOREIGN PATENT DOCUMENTS

CH 568663 A5 10/1975
DE 1605266 U 4/1950
(Continued)

*Primary Examiner* — Chandrika Prasad
(74) *Attorney, Agent, or Firm* — Laubscher, Spendlove & Laubscher, P.C.

(57) ABSTRACT

A connection terminal for connecting an electrical device to a continuous electrical conductor such as a ground conductor includes a connector body with at least one terminal connection. Each terminal connection includes a recess which extends in a direction of extension of the electrical conductor and a holding device to at least partially close the recess. The holding device is adjustable relative to the direction of extension of the electrical conductor from an open position in which the electrical conductor can be inserted into the recess to a closed position in which the holding device holds the electrical conductor in the recess. The holding device is either reversibly rotatable in a direction of rotation around an axis which extends in the direction of extension or reversibly displaceable in a sliding direction which extends transverse to the direction of extension. The terminal connection includes a clamping means device
(Continued)

which clamps the electrical conductor and/or the holding device in the closed position.

15 Claims, 6 Drawing Sheets

(51) Int. Cl.
*H01R 13/502* (2006.01)
*H01R 13/518* (2006.01)
*H01R 9/24* (2006.01)

(58) Field of Classification Search
USPC ..... 439/718, 517, 803, 806, 810, 781–783, 439/789, 807
See application file for complete search history.

(56) References Cited

U.S. PATENT DOCUMENTS 4,723,920 A * 2/1988 Werner ..... H01R 4/5091 439/782
6,325,677 B1 * 12/2001 Tamm ..... H01R 4/40 439/789
6,347,967 B1 * 2/2002 Tamm ..... H01R 4/40 403/322.1
7,097,518 B2 * 8/2006 Kraemer ..... H01R 4/40 439/806
7,677,933 B2 * 3/2010 Copper ..... H01R 4/5091 174/94 S
9,263,859 B2 * 2/2016 Cardin ..... H01R 4/40
2012/0088380 A1 4/2012 Smith
2012/0115273 A1 5/2012 Pini
2013/0137294 A1 5/2013 Cardin et al.

FOREIGN PATENT DOCUMENTS

EP 0986134 A1 3/2000
FR 1080146 A 12/1954
FR 2129103 A5 10/1972
WO 2011112104 A1 9/2011

* cited by examiner

CONNECTION TERMINAL HAVING A CLAMPING DEVICE ENGAGING AND CLAMPING A HOLDING DEVICE FOR CLAMPING AN ELECTRICAL CONDUCTOR

This application is a § 371 National Stage Entry of PCT International Application No. PCT/EP2015/068476 filed on Aug. 11, 2015. PCT/EP2015/068476 claims priority of DE 202014103754.3 filed Aug. 13, 2014. The entire contents of these applications are incorporated herein by reference.

BACKGROUND OF THE INVENTION

The invention relates to a connection terminal for a continuous electrical conductor, in particular a ground conductor.

Electrical devices, for example, machines and apparatuses, are grounded for the protection of humans and animals against electrical shock. For this purpose, electrically conductive components of the devices such as housing components which may come in contact with a person and which are not part of the operating current circuit of the electrical machine or of the housing are connected to a ground line. This ground line is connected to ground of the supply voltage network. The devices can also be grounded jointly or separately via a protective ground such as for example, in the ground.

In order to ground the electrical devices jointly, a grounded conductor is connected to all the devices. For this purpose, a continuous ground conductor is used.

The purpose of the subject matter of this disclosure is to provide an easy-to-handle connection terminal which enables a rapid and reliable connection of the electrical devices to the continuous ground conductor without splitting said ground conductor.

SUMMARY OF THE INVENTION

The connection terminal is provided for the connection of an electrical device to a continuous electrical conductor, in particular a ground conductor. The conductor preferably includes multiple strands or wires surrounded by an insulation material. The connection terminal has a connector body which includes a terminal connection containing a recess extending in a direction through which the electrical conductor extends. In addition, the connection terminal includes a holding device to at least partially close the recess. The holding device is reversibly adjustable from an open position in which the electrical conductor can be inserted into the recess to a closed position. In the closed position, the holding device holds the electrical conductor in a radial direction around the extension direction in the recess.

The holding device is reversibly rotatable in a direction of rotation around an axis extending in the extension direction or displaceable in a sliding direction which extends transverse to the extension direction. In addition, the terminal connection includes a clamp which clamps the electrical conductor and/or the holding device in the closed position.

Therefore, the electrical conductor can be connected with the connection terminal merely by inserting the conductor into the recess in the direction of extension of the conductor and by adjusting the holding device from the open position to the closed position Preferably, the holding device is rotatably connected with the connector body.

The holding device includes a contact surface for receiving the electrical conductor in the open position. Preferably, the contact surface holds the electrical conductor in the closed position within the recess. For this purpose, the holding device includes a first arm on which the contact surface is arranged. In this embodiment, the electrical conductor applied against the contact surface is placed in the recess when the holding device is rotated. This can be done rapidly and simply.

The first arm is provided in order to at least partially close the recess in the closed position.

Particularly preferably, the connector body and the first are of the holding device jointly surround the electrical conductor in the closed position. Most particularly, they surround the entire periphery of the electrical conductor.

In order to prevent the holding device from becoming detached in the closed position and to hold the ground conductor securely in the connection terminal even under strong vibrational stress, the terminal connection includes a clamping device. The clamping device is provided in order to clamp the holding device in the closed position.

In a first preferred embodiment, the clamping device acts directly with the holding device. In a second preferred embodiment, the clamping device acts indirectly with the holding device.

The clamping device is preferably a clamping screw which is adjustable in a clamping direction and counter to the clamping direction transversely to the extension direction of the electrical conductor and which ensures the contact position. The clamping screw preferably has a clamping surface. The clamping surface is preferably arranged at an open end of the clamping screw and extends transversely to the direction of rotation of the clamping screw.

In a first embodiment, in the closed position, the clamping surface abuts directly against the holding device, in particular against a second arm of the holding device. In a second embodiment, in the closed position, the clamping surface butts directly against the electrical conductor. In this embodiment, the clamping device acts on the electrical conductor together with the holding device, preferably with the second arm of the holding device. The second arm in this embodiment acts as a lever, on the end of which the first arm is arranged. In both embodiments, the clamping device prevents undesired adjustment of the holding device from the closed position into the open position so that the electrical conductor is reliably held in the closed position.

The holding device is designed in the shape of an L and can be produced easily and cost effectively as a punched element.

The holding device is rotatably mounted in a bearing bore of the connector body so that it can be easily rotated. Moreover, the holding device includes a through bore to accommodate a rotary shaft such as a cotter pin which is arranged between the first arm and the second arm. In the open position, the holding device thereby forms a support which, when the holding device is rotated, guides the electrical conductor in the direction of rotation into the recess. In the closed position, the second arm of the holding device can be used for clamping the holding device.

The rotary shaft is preferably formed as a bar or a spring cotter pin. As a result, the cotter pin is self-retaining.

The connection terminal includes a conductor connection for connection of an additional electrical conductor. The additional electrical conductor is preferably a connection conductor of the electrical device, wherein the electrical conductor is preferably a ground conductor. The conductor connection can be designed either as a terminal connection or as a conventional conductor connection.

The connection terminal preferably has a plane symmetric or point symmetric design. In this embodiment, it also includes a terminal connection with a recess in which the continuous conductor can be inserted in the extension direction thereof and connected. However, in another embodiment of the connection terminal, the connection terminal also includes such a terminal connection but does not have a symmetric design. In yet another embodiment, the conductor connection is a conventional conductor connection which is formed for the connection of a conductor end such as a push-in connection.

The connection terminal is electrically conductive. Preferably it is manufactured from a metal such as brass or a metal alloy. The terminal has a low-ohmic design and good current load capacity.

BRIEF DESCRIPTION OF THE FIGURES

Other objects and advantages of the invention will become apparent from a study of the following description when viewed in the light of the accompanying drawing, in which.

DETAILED DESCRIPTION

Figure 1A:
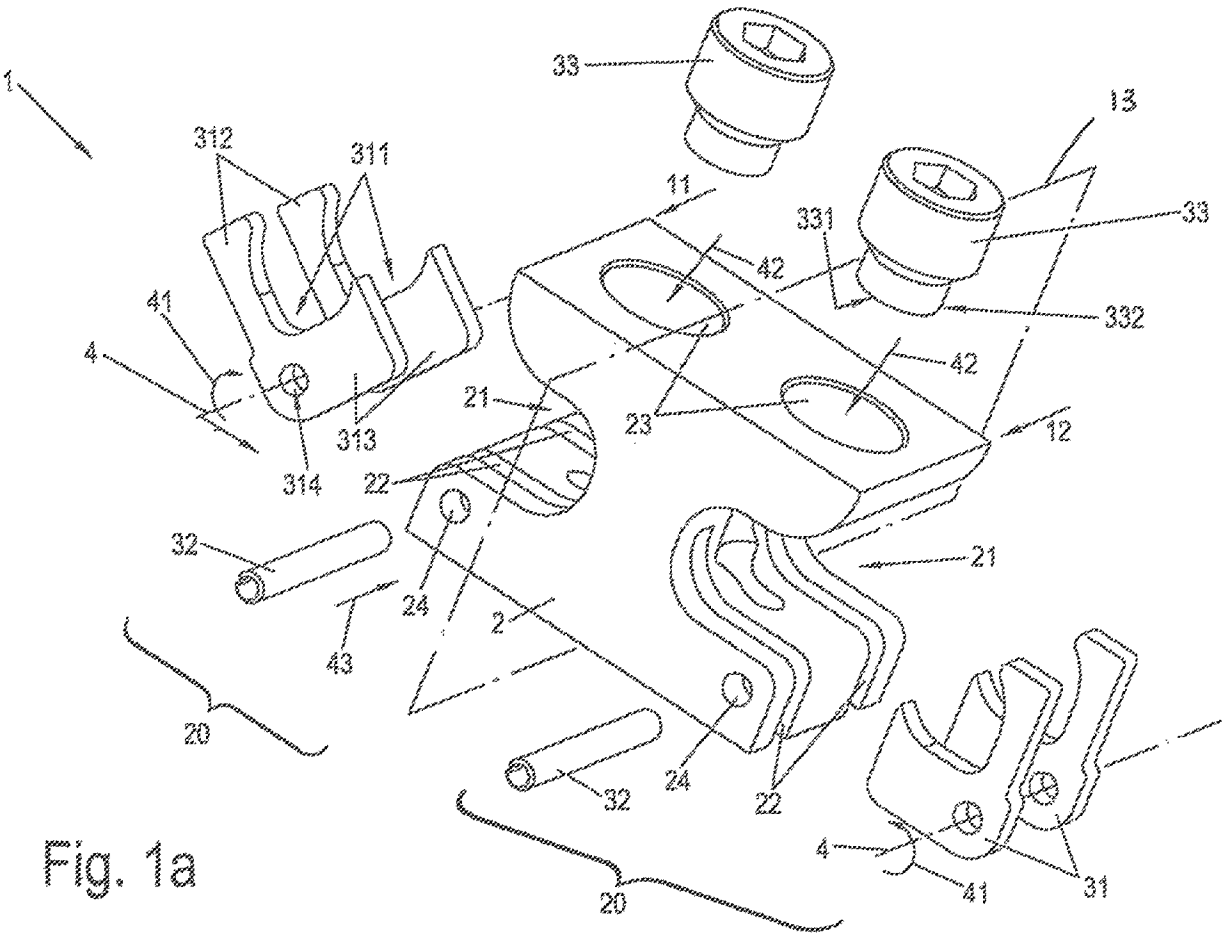
FIGS. 1*a* and 1*b* are exploded and cross-sectional views, respectively of a connection terminal according to a first embodiment of the invention.
Figure 1B:
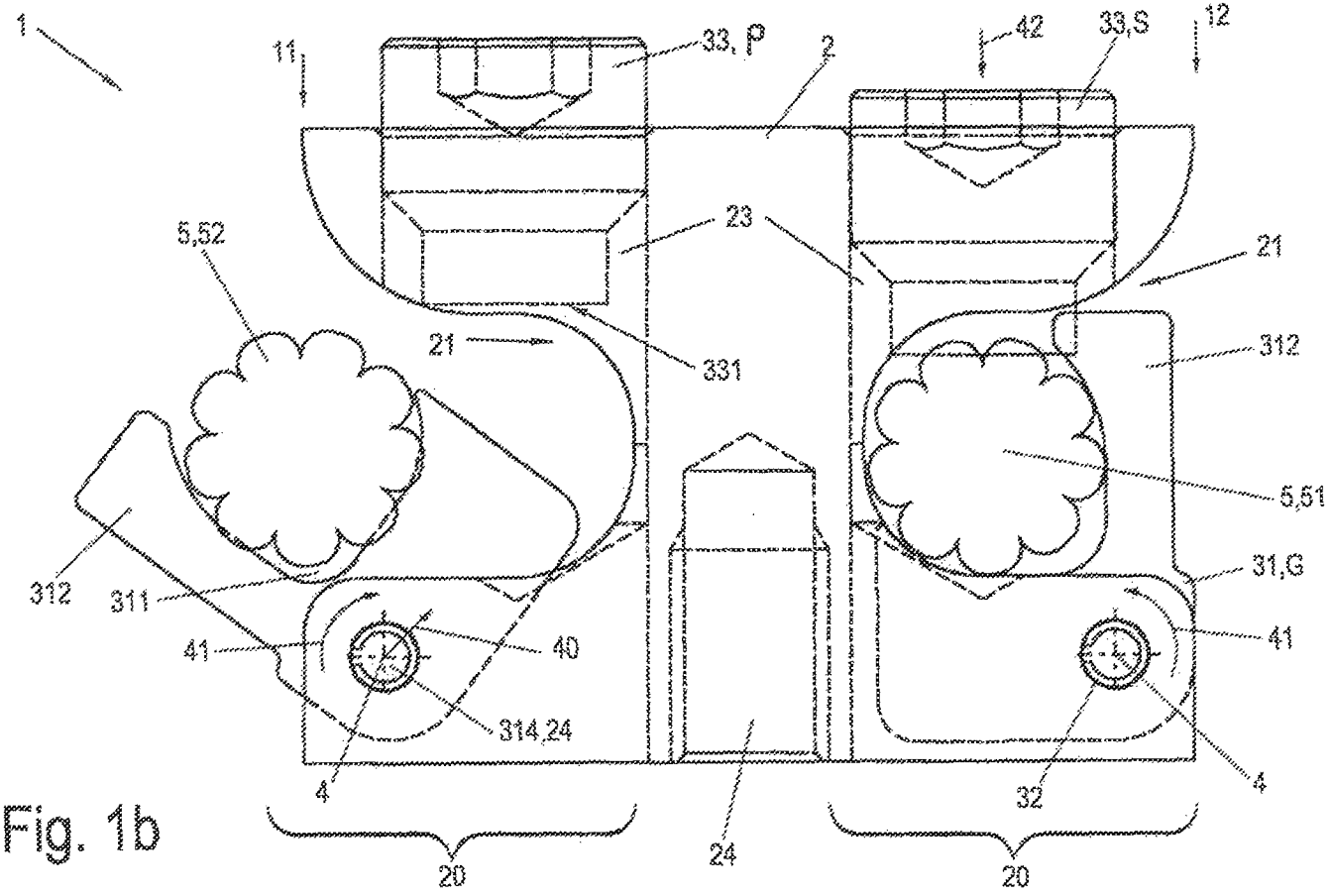

Referring first to FIGS. 1*a* and 1*b*, a first embodiment of a connection terminal 1 will be described.

The connection terminal 1 includes a connector body 2 and a terminal connection 20 including at least one recess 21 which extends in an extension direction 43. More particularly, the extension direction is the direction along which an electrical conductor adapted to be connected with the connection terminal extends. As shown in FIG. 1*b*, a continuous electrical conductor such as a wire 5 is inserted into the recess in the extension direction 43. The connection terminal 1 provides an electrically conductive connection between two electrical conductors 5 such as a ground conductor 51 and a connection conductor 52 to ground an electrical device (not shown). The connection terminal can also be used to provide an electrical connection between two electrical conductors 5 having another function.

In order to hold or retain the electrical conductor 5 within the recess 21, the connection terminal 1 includes a holding device 31. The holding device 31 at least partially and preferably completely closes the recess 21. For this purpose, the holding device 31 is connected with the connector body 2 for rotation around an axis 4 extending in the extension direction 43.

The holding device 31 is configured in the shape of an L and includes a first arm 312 and a second arm 313. In the area where the first arm 312 joins the second arm 313, a through bore 314 is provided.

The connector body 2 includes a bearing bore 24. In a mounted state, the bearing bore 24 of the connector body 2 and the through bore 314 of the holding device 31 are arranged in alignment with one another to receive a rotary shaft 32 which extends concentrically with the axis 4.

The holding device 31 is mounted in a fixed manner on the rotary shaft 32. The rotary shaft 32 passes through the bearing bore 24 and the through bore 314. As a result, the holding device 31 turns or rotates with the rotary shaft 32 in a direction of rotation 41 or counter to it around the axis 4. Accordingly, the holding device can be turned in the direction of rotation 41 from an open position O, in which the electrical conductor 5 can be inserted in the recess 21, to a closed position G, in which the holding device 31 holds the electrical conductor 5 in a radial direction 40 around the axis 4 in the recess 21. The open O and closed G positions of the holding device are shown in particular in connection with the embodiment of FIGS. 3*b* and 3*c*.

The holding device 31 has a contact surface 311 for connection with the electrical conductor 5. The contact surface 311 is arranged on the first and second arms 312, 313. It extends on an inner surface of the first and second arms 312, 313 which faces the connector body 2 particularly when the holding device is in the closed state G.

In order to place the electrical conductor 5 in the recess 21, the electrical conductor 5 is placed against a contact surface 311 of the holding device when the device is in the open state O as shown in FIG. 1*b*. By rotating the holding device 31 in the direction of rotation 41, the electrical conductor is introduced into the recess 21 which is closed simultaneously by the holding device 31 and particularly by the first arm 312 of the holding device 31 as shown in FIG. 1*b*.

In the closed state G of the holding device 31, the electrical conductor 5 is held with the first arm 312 of the holding device 31 in the recess 21. The first arm 312 almost completely closes the recess 21. The first arm 312 and the connector body 2 therefore jointly almost completely surround the electrical conductor 5 in the closed position G. The electrical conductor 5 is then held captive in the recess 21. The recess 21 is dimensioned so that, in the closed position G, the electrical conductor 5 contacts the connector body 2 in an electrically conductive manner. For that purpose, the connector body 2 is electrically conductive so that no additional components are needed for producing an electrically conductive contact between the electrical conductor 5 such as the ground conductor 51 and an additional electrical conductor 5 such as the connection conductor 52 connected to the connector body 2.

In order to hold the holding device 31 in the closed position G, the terminal connection 20 further includes a clamping device 33. The clamping device 33 is preferably a clamping screw. The clamping screw is connected with a through bore 23 of the connector body 2 which extends transversely to the extension direction 43 and is adjusted via rotation in a clamping direction 42 from a home position P into a securing position S securing the holding device 31 in the closed position G. The clamping device 33 has a clamping surface 331, which is arranged on a lower end 332 of the clamping device 33 facing the recess 21. The clamping surface 331 extends transversely to the clamping direction 42.

In the embodiment shown in FIGS. 1*a* and 1*b*, the clamping device 33 when rotated into the securing position S presses or clamps the electrical conductor 5 into the recess 21 when the holding device 31 is in the closed position G.

For the clamping device 33 to hold the holding device 31 in the closed position G, the second arm 313 of the holding device is provided. The second arm 313 is at least partially arranged in a receiving groove 22 which is arranged under the recess 21 of the connector body. The receiving groove 22 extends into the connector body 2 of the connection terminal 1 and is arranged transverse to the extension direction 43 of the electrical conductor.

In the closed position G, the holding device second arm 313 is accommodated in the receiving groove 22. Since the electrical conductor 5 in the securing position S is pressed by the clamping device 33 in the clamping direction 42 into the recess 21, the clamping device 33 acts indirectly on the holding device 31 in the securing position S via the electrical conductor 5. As a result, the holding device 31 is held in the closed position G.

The connection terminal 1 has a symmetric design with respect to a plane of symmetry 13 extending parallel with the extension direction 43. The connection terminal 1 therefore includes two terminal connections 20 to which a respective continuous electrical conductor 5 can be connected. The terminal connections 20 are arranged on first and second sides 11, 12 of the plane of symmetry 13.

In addition, for each terminal connection 20, two spaced parallel holding devices 31 are provided. The clamping device 33 for each of the two terminal connections 20 is arranged between the two holding device 31 of each respective terminal connection 20.

FIG. 2 shows an additional embodiment of a connection terminal 1. However, in this connection terminal 1 only one holding device 31 is provided for each terminal connection for a respective electrical conductor 5. The connection terminal 1 has a symmetric design with respect to an axis of symmetry 14. It is also designed for the connection of two continuous electrical conductors 5.

The connection terminal 1 of this embodiment differs from the embodiment of FIG. 1 moreover in that the holding devices 31 in each case act directly together with the clamping device 33 associated with the same terminal connection 20.

For this purpose, in the home position, the clamping device 33 abuts against a first contact point 315 of the second arm 313 of the holding device 31 when the holding device 31 is in the open position. By rotating the holding device 31 in the direction of rotation 41, the holding device is rotated to the closed position G. In order to secure the holding device 31 in the closed position G, the clamping device 33, which is preferably a clamping screw, is shifted by rotating in the clamping direction 42 until it butts against a second contact point 316 of the second arm 313 of the holding device 31.

An advantage of this embodiment is that the clamping device 33 does not press against the electrical conductor 5. In addition, the electrical conductor 5 is clamped between the connector body 2 and the first arm 312 of the holding device 31. As a result, the terminal connection 20 of this embodiment can be used for electrical conductors 5 of different conductor cross sections. The two closure variants work with different conductor cross sections.

Figure 2A:
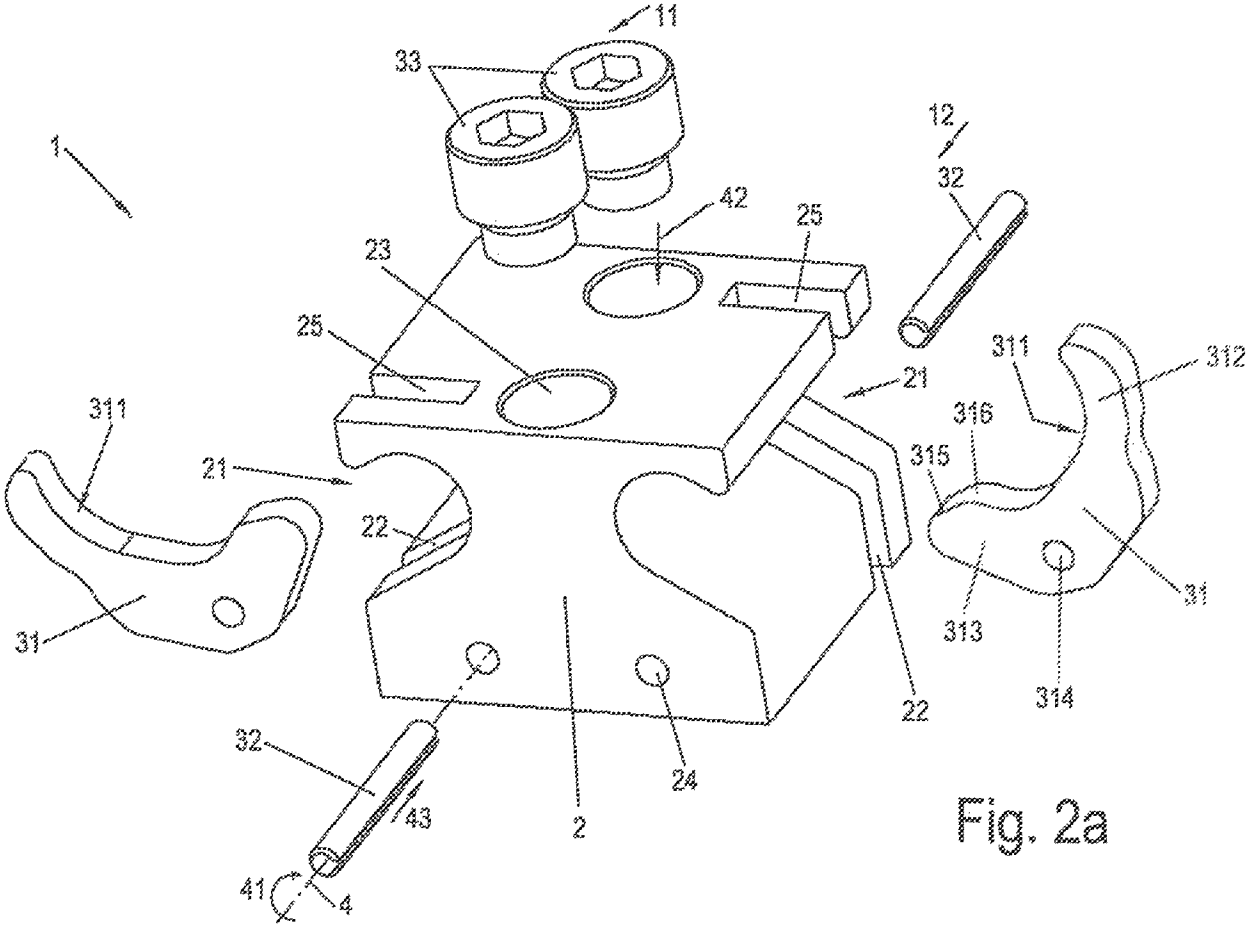
FIGS. 2*a* and 2*b* are exploded and cross-sectional views, respectively, of a connection terminal according to a second embodiment of the invention.
Figure 2B:
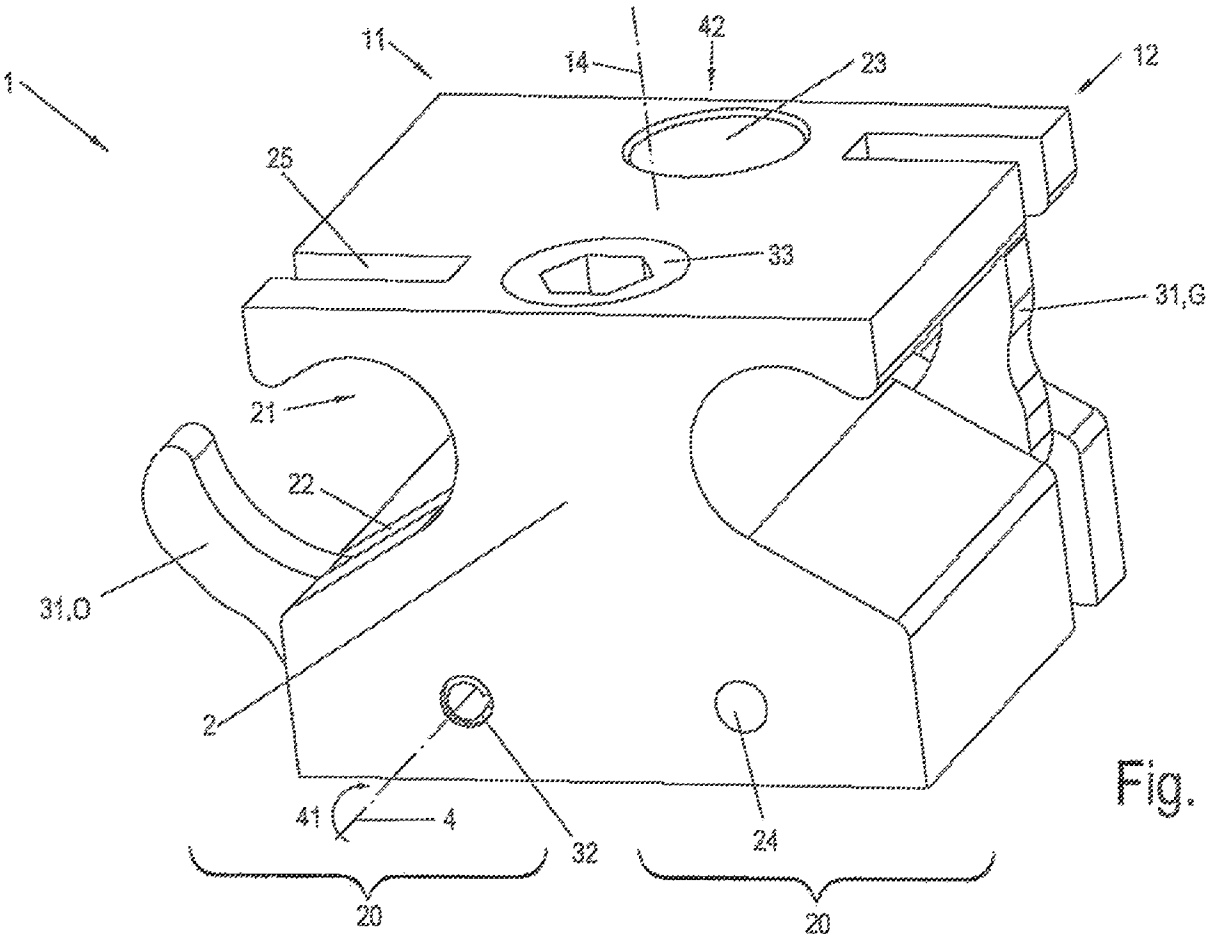

In the embodiment of FIGS. 2*a* and 2*b*, the first arm 312 of a holding device 31 in the closed position G extends counter to the clamping direction 42 beyond the recess 21. Therefore, the connector body 2 contains an indention 25 in alignment with the receiving groove 22 for the holding device 31 into which the second arm 312 protrudes when the holding device is in the closed position G. An electrical conductor 5 inserted in the recess 21 in the closed position G is therefore surrounded over its entire periphery by the connector body 2 and the holding device 31.

Figure 3A:
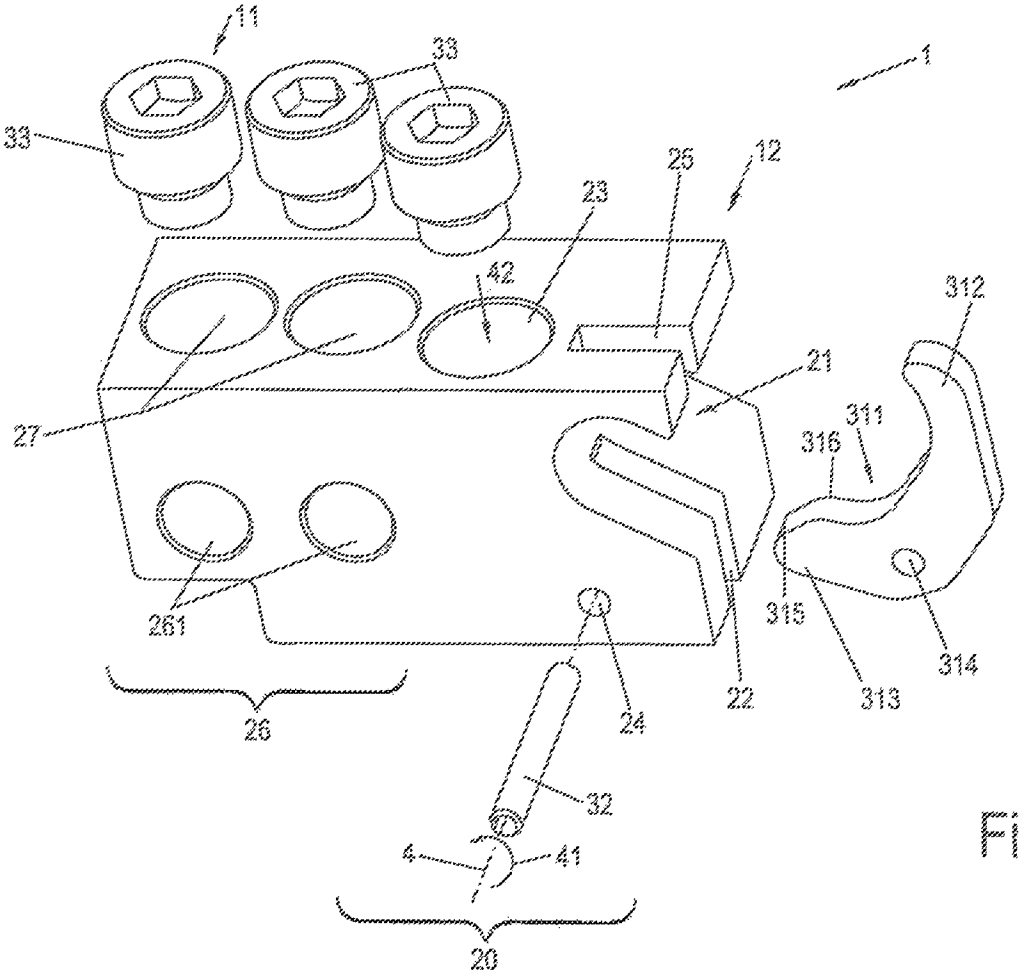
FIG. 3*a* is an exploded view of a connection terminal according to a third embodiment of the invention.
Figure 3B:
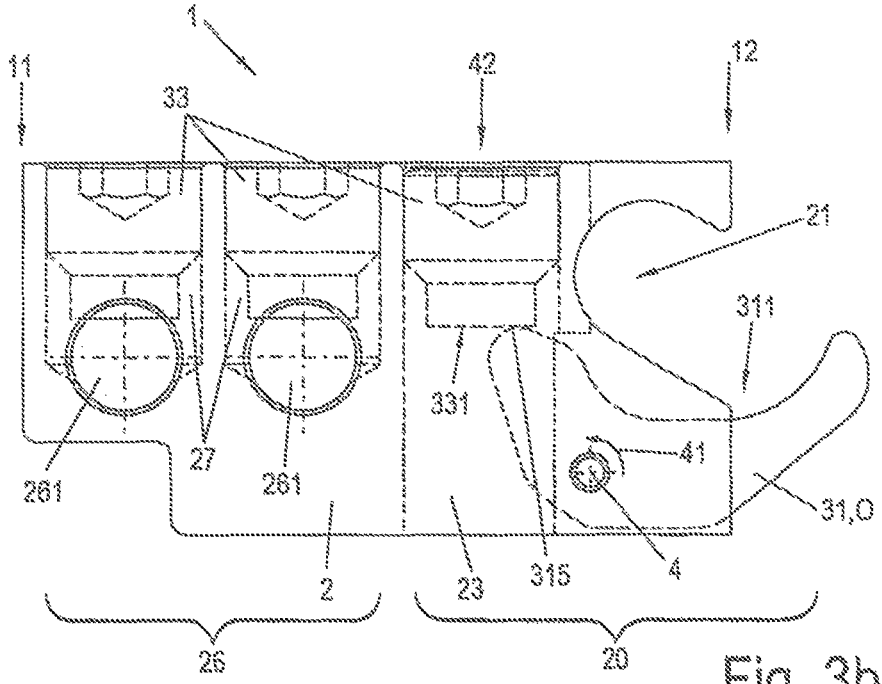
FIGS. 3*b* and 3*c* are sectional views of the terminal of FIG. 3*a* in the open and closed positions, respectively.
Figure 3C:
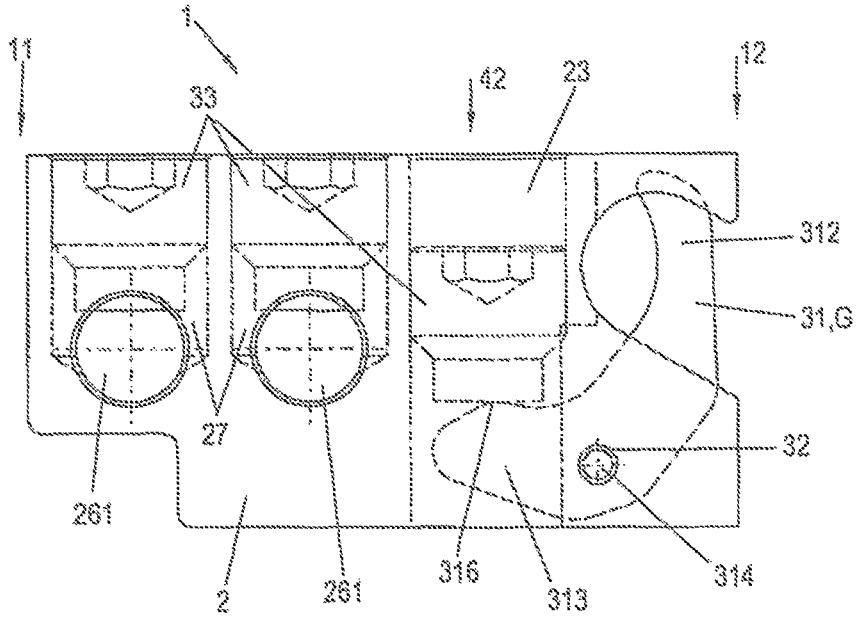

In the embodiment of the connection terminal 1 shown in FIGS. 3*a*-3*c*, only one of the conductor connections is designed in the form of a terminal connection 20 which is arranged here on the second side 12 of the connection terminal 1. The connection terminal 1 further includes two conventional conductor connections 26, which are formed, for example, as push-in connections. One of the two conductor connections 26 is arranged on the first side 11 of the connection terminal 1 and the other is arranged between the terminal connection 20 and the conductor connection 26 arranged on the first side 11. The connection terminal 1 is therefore of asymmetric design. The conventional conductor connections 26 are in each case represented diagrammatically by a conductor connection opening 261 and a clamping screw 33 which is arranged in a bore 27.

The terminal connection 20 of this connection terminal 1 is similar to those of the connection terminal 1 described in connection with FIGS. 2*a* and 2*b*. FIGS. 3*b* and 3*c* show the collaboration of the clamping device 33 with the holding device 31 in the open position O and in the closed position G, respectively.

FIGS. 3*b* and 3*c* show sections through the connector body 2 of the connection terminal 1 of FIG. 3*a* on the second side 12. The rotary shaft or pin 32 extends in the extension direction 43 and the holding device 31 is fixed on the rotary shaft 32. In order to close the recess 21, the holding device 31 and the rotary shaft 32 are jointly rotated around the axis 4 until the first arm 312 of the holding device engages in the indentation 25 of the connector body 2.

The rotary shaft 32 is designed as a spring cotter pin. As a result, the cotter pin is self-retaining, even in the case of severe vibrations.

While the preferred forms and embodiments of the invention have been illustrated and described, it will be apparent to those of ordinary skill in the art that various changes and modifications may be made without deviating from the inventive concepts set forth above.

The invention claimed is:

1. A connection terminal for connecting an electrical device with an electrical conductor extending in a first direction, comprising (a) a connector body;

(b) at least one terminal connection assembly including (1) a recess within said connector body and extending in said first direction; and (2) a holding device rotatably connected with said connector body and operable between an open position in which the electrical conductor can be inserted into said recess and a closed position to at least partially close said recess and retain the electrical conductor in said recess, said holding device rotating about an axis parallel to said first direction; and (c) a clamping device connected with said connector body for engaging and clamping said holding device in the closed position, said holding device clamping the electrical conductor within said recess against said connector body.

2. A connection terminal as defined in claim 1, wherein said connector body includes a bearing bore for rotatably connecting said holding device with said connector body.

3. A connection terminal as defined in claim 2, wherein said holding device includes a contact surface for receiving the electrical conductor when said holding device is in the open position and retaining the electrical conductor in said recess when said holding device is in the closed position.

4. A connection terminal as defined in claim 3, wherein said holding device includes a first arm and said contact surface is arranged on said first arm.

5. A connection terminal as defined in claim 3, wherein said contact surface is arranged opposite and faces said connector body recess.

6. A connection terminal as defined in claim 1, wherein said connector body and said holding device surround the electrical conductor when said holding device is in the closed position.

7. A connection terminal as defined in claim 1, wherein said connector body contains a through bore extending normal to said first direction and wherein said clamping device comprises a clamping screw operable within said through bore between a clamping position and a release position.

8. A connection terminal as defined in claim 7, wherein said holding device includes a second arm and said clamping screw includes a clamping surface which abuts against said holding device second arm when said holding device is in the closed position and said clamping screw is in the clamping position.

9. A connection terminal as defined in claim 8, wherein said holding device has an L shaped configuration.

10. A connection terminal as defined in claim 8, wherein said holding device contains a through bore between said first arm and said second arm for receiving a rotary pin, said holding device being fixed to said pin.

11. A connection terminal as defined in claim 1, wherein said connector body includes a terminal connection assembly on each side of said connector body.

12. A connection terminal as defined in claim 11, wherein said connector body is formed of an electrically conductive material.

13. A connection terminal as defined in claim 1, wherein said connector body is point symmetric and includes at least one conductor connection on one side and said terminal connection assembly on another side, said conductor connection receiving an additional electrical conductor.

14. A connection terminal as defined in claim 13, wherein said connector body is formed of an electrically conductive material.

15. A connection terminal as defined in claim 4, wherein said connector body, contains an indentation for receiving said holding device first arm when said holding device is in said closed position.

* * * * *